US005408159A

United States Patent [19]

Maillot et al.

[11] Patent Number: 5,408,159

[45] Date of Patent: Apr. 18, 1995

[54] DEFLECTION YOKE WITH A FORKED SHUNT

[75] Inventors: Andre Maillot, Dijon; David Perron, Auxonne, both of France

[73] Assignee: Thomson Tubes and Displays, S.A., France

[21] Appl. No.: 197,996

[22] Filed: Feb. 17, 1994

[30] Foreign Application Priority Data

Feb. 18, 1993 [EP] European Pat. Off. ..... 93400431

[51] Int. Cl.[6] ..... H01J 29/70

[52] U.S. Cl. ..... 313/440; 313/425; 313/412; 313/413; 313/414; 313/421; 313/428; 313/441; 313/442

[58] Field of Search ..... 313/440, 425, 412, 413, 313/414, 421, 428, 441, 442

[56] References Cited

U.S. PATENT DOCUMENTS

| | | | |
|---|---|---|---|
| 4,246,560 | 1/1981 | Shimizu et al. | 335/212 |
| 4,433,268 | 2/1984 | Arisato | 313/440 |
| 4,636,684 | 1/1987 | Yokota et al. | 313/1440 |
| 4,876,479 | 10/1989 | Kawabata et al. | 313/440 |

FOREIGN PATENT DOCUMENTS

| | | | |
|---|---|---|---|
| 0159084 | 10/1985 | European Pat. Off. | H01J 29/76 |
| 0236236 | 6/1983 | Japan | 313/440 |
| 0315931 | 6/1988 | Japan | 313/440 |
| 0114123 | 9/1989 | Japan | 313/440 |
| 2076219 | 5/1980 | United Kingdom | 313/440 |
| WO91/18410 | 11/1991 | WIPO | H01J 29/76 |

OTHER PUBLICATIONS

Derwent DE 004309944A1.

*Primary Examiner*—Donald J. Yusko
*Assistant Examiner*—Ali Horri
*Attorney, Agent, or Firm*—Joseph S. Tripoli; Joseph J. Laks; Sammy S. Henig

[57] ABSTRACT

A pair of E-shaped shunts are disposed near the top and bottom, respectively, of a deflection yoke for reducing inner and outer horizontal trap errors. A central portion of the E-shaped shunt reduces a ratio between magnitudes of inner and outer E-W pincushion raster distortions.

13 Claims, 9 Drawing Sheets

FIG. 6a
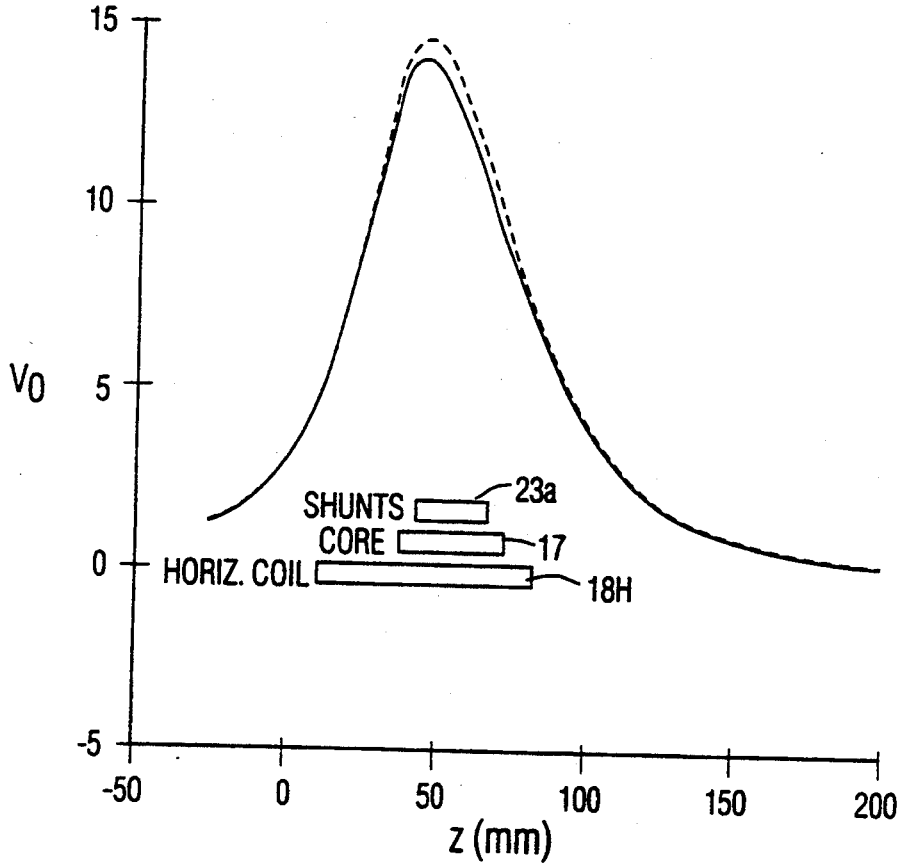
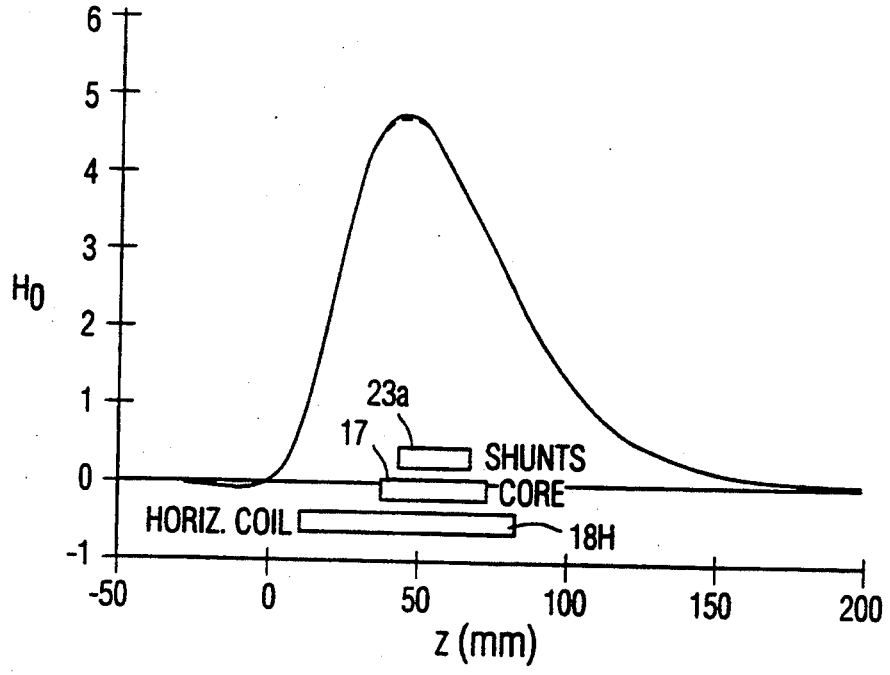
FIG. 6b

DEFLECTION YOKE WITH A FORKED SHUNT

The invention relates to a color picture tube (CRT) display system.

The electrons of each of the three electron beams of the CRT, R, G and B, will traverse a greater distance when deflected towards the edge of the viewing screen than when directed toward the center. Due to the separation of the electron guns, this may result in a separation of the landing points of the three electron beams when they are deflected towards the edges of the screen. This effect causes the light spots of the three beams at points on the viewing screen away from the center to be separated. This is known as misconvergence and results in color fringes about the edges of the displayed images. Misconvergence may be measured as a separation or distance of the ideally superimposed red and blue lines of a crosshatch pattern of lines appearing on the screen when an appropriate test signal is applied to the picture tube.

Each of the three electron beams scans a raster which may be identified by its color. Thus, a green raster is ordinarily scanned by the center electron beam and the outside beam scan red and blue rasters, respectively. The crosshatch pattern is formed in each of the red, green and blue rasters. The crosshatch pattern outlines the raster with generally vertical and horizontal lines, and also includes other intermediate vertically and horizontally-directed lines.

The field flux lines produced by the vertical deflection winding are made barrel-shaped at a portion of the yoke that is intermediate the gun end and the screen end of the yoke. Such field nonuniformity reduces misconvergence at the 12 o'clock point. To enhance the barrel-shaped vertical field nonuniformity, a pair of shunts near the top and bottom of the yoke, respectively, have been utilized.

An outer horizontal trap misconvergence error is defined as the separation between horizontal red and blue lines at the top or bottom of the screen of the CRT. An inner horizontal trap misconvergence error is defined at a region of the CRT screen midway between the top and center of the CRT screen, or midway between the bottom and center of the CRT screen. A CRT having an aspherical or flat faceplate may tend to introduce a significant difference between the outer and inner horizontal trap errors.

It may be desirable to reduce a difference between the outer and inner horizontal trap errors. The reduction of such difference facilitates reduction of an overall outer/inner horizontal trap error.

In a deflection apparatus embodying an aspect of the invention, a pair of forked shunts are placed near the top and bottom, respectively, of the deflection yoke. Each forked shunt includes a pair of outer branch members. The angular position in the X–Y plane occupied by the shunt varies as a function of the coordinate Z along the longitudinal Z-axis of the CRT. Therefore, the forked shunt varies the vertical deflection field nonuniformity at different X–Y planes of the yoke that are perpendicular to the Z-axis of the yoke. As a result, the aforementioned difference between outer and inner horizontal trap error is reduced.

Due to the flatness of the faceplate of the CRT, the magnitude of an East-West pincushion distortion may vary in a non-linear manner as a function of the coordinate X of the beam along the X-axis of the screen of the CRT. Such non-linear variation may hinder conventional East-West distortion correction circuitry from fully correcting the distortion.

It may be desirable to utilize the forked shunts in such a way that a ratio between a magnitude of an inner East-West geometry distortion error and that of an outer East-West geometry distortion error is greater than a predetermined value. By maintaining such ratio greater than a predetermined value, conventional East-West pincushion distortion correction circuits can be used for providing overall acceptable inner/outer East-West pincushion distortion correction.

In accordance with an inventive feature, the forked shunt includes a center branch member between the outer branch portions. Advantageously, the center branch member increases the ratio between the magnitude of the inner East-West geometry distortion error and that of the outer East-West geometry distortion error.

A deflection apparatus, embodying an aspect of the invention, includes a cathode ray tube of an in-line system including an evacuated glass envelope. A display screen is disposed at one end of the envelope. An electron gun assembly is disposed at a second end of the envelope. The electron gun assembly produces a plurality of electron beams that form corresponding rasters on the screen upon deflection. A deflection yoke is mounted around the envelope and includes a vertical deflection coil for producing a vertical deflection field in the cathode ray tube. A horizontal deflection coil produces a horizontal deflection field in the cathode ray tube. A core made of magnetically permeable material is magnetically coupled to the vertical and horizontal deflection coils. A first field former is disposed adjacent to one of the deflection coils and between opposite ends thereof for modifying one of the deflection fields. The field former includes a center leg and two outer legs spaced apart in a transverse direction and a member connecting together the plurality of legs.

Figure 1:
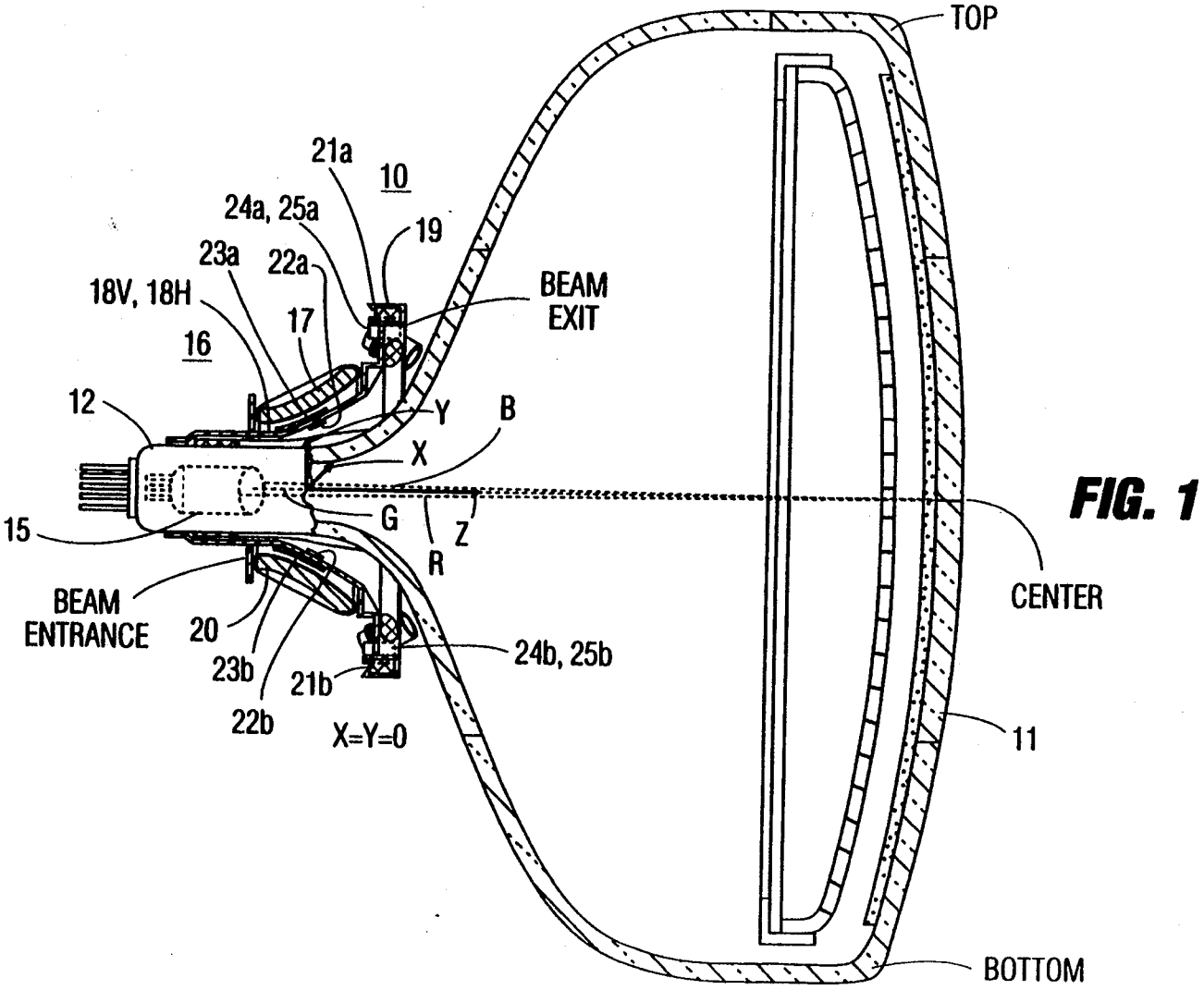
FIG. 1 illustrates a side view of a deflection yoke embodying an aspect of the invention that is mounted on a cathode ray tube.
Figure 4A:
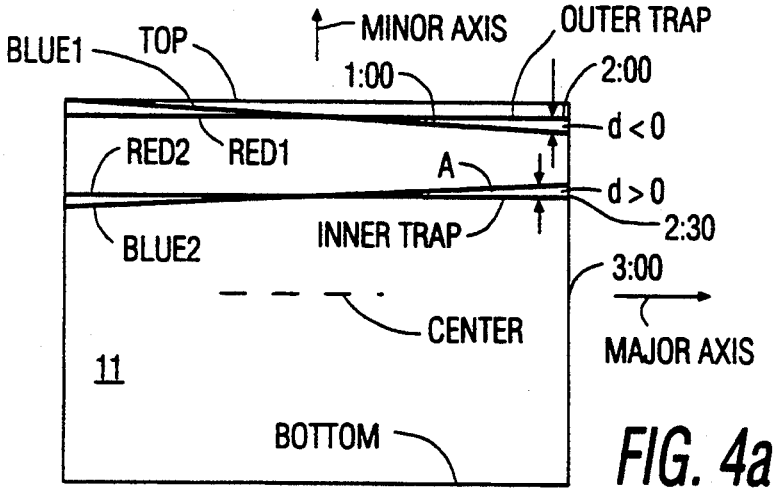
Figure 4B:
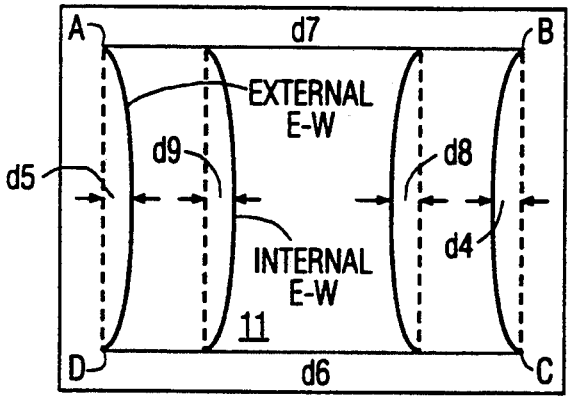
Figure 5A:
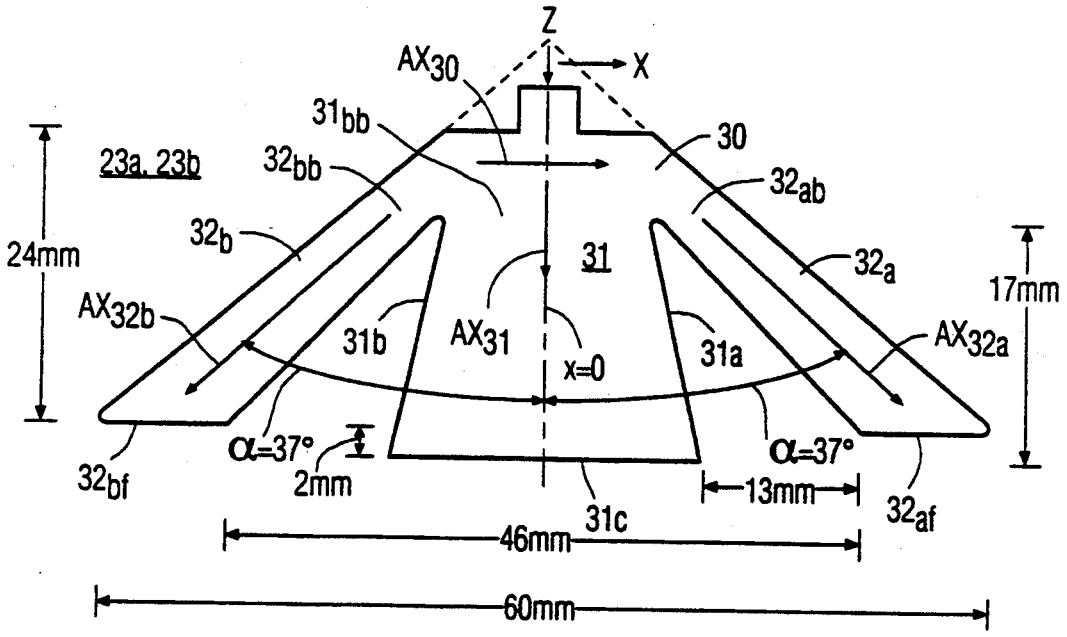
Figure 5B:
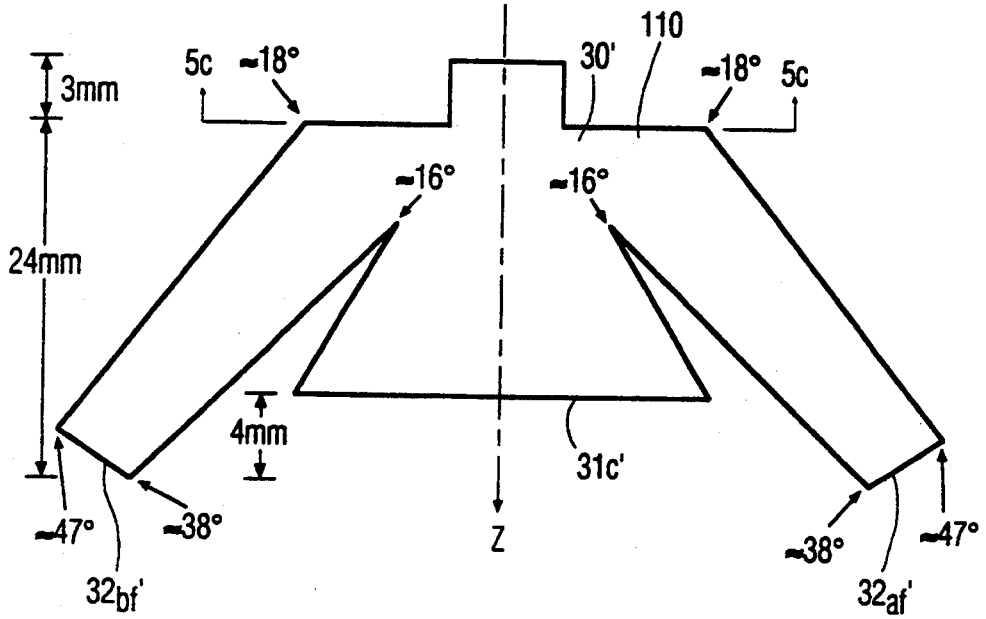

FIGS. 4*a* and 4*b* illustrate, each, a corresponding display pattern on a screen of a cathode ray tube for explaining corresponding beam landing errors;

FIG. 5*a* illustrates a shunt embodying an aspect of the invention that is used in the yoke of FIG. 1;

FIG. 5*b* illustrates a shunt embodying an aspect of the invention that can be used in the yoke of FIG. 1 instead of the shunt of FIG. 5*a;*

Figure 5C:
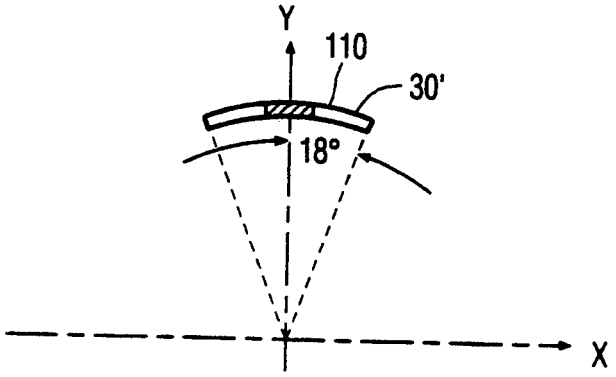
Figure 5D:
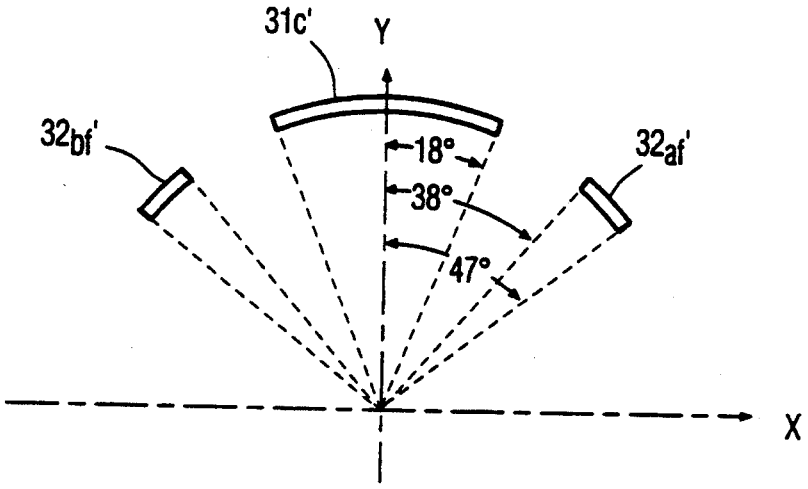

FIGS. 5*c* and 5*d* illustrate the angular positions in the corresponding X–Y plane occupied by the back and front portions, respectively, of the shunt of FIG. 5*b;* and FIGS. 6*a*–6*f* illustrate field distribution functions of the yoke of FIG. 1.

In FIG. 1, a CRT 10 includes a screen or faceplate 11 upon which are deposited repeating groups of red, green and blue phosphor trios. CRT 10 is of the type A68EET38X110 with a Super-Flat faceplate size 27 V or 68 centimeter. The deflection angle is 108°. The distance from the yoke reference line to the inside of the screen at the screen center, referred to as the throw distance, is 275 millimeter. Faceplate 11 is much flatter than typical CRT's and sagittal heights are only half that of typical face contour.

The contour of the inner surface of the faceplate 11 is defined by the following equation.

$$Z_c = A1 \cdot X^2 + A2 \cdot X^4 + A3 \cdot X^6 + A^4 \cdot Y^2 + A5 \cdot X^2 \cdot Y^2 + A6 \cdot X^4 \cdot Y^2 + A7 \cdot X^6 \cdot Y^2 + A8 \cdot Y^4 + A9 \cdot X^2 \cdot Y^4 + A10 \cdot X^4 \cdot Y^4 + A11 \cdot X^6 \cdot Y^4 + A12 \cdot Y^6 + A13 \cdot X^2 \cdot Y^6 + A14 \cdot X^4 \cdot Y^6 + A15 \cdot X^6 \cdot Y^6$$

where:

$Z_c$ is the distance from a plane tangent to the center of the inner surface contour.

X and Y represent distances from the center, in the directions of the major and minor axes, respectively.

A1 to A15 are coefficients that depend on the diagonal dimension of the faceplate.

For a tube faceplate of CRT 10 with a viewing screen having a diagonal dimension of 68 cm, suitable coefficients A1 to A15 are shown in Table I. A CRT with the contour defined by these coefficients may benefit in convergence characteristics when using inventive features described below. The X and Y dimensions must be in millimeters to use the coefficients of the Table.

TABLE

| | |
|---|---|
| A1 = | $0.2380978 \times 10^{-03}$ |
| A2 = | $0.1221162 \times 10^{-09}$ |
| A3 = | $0.9464281 \times 10^{-14}$ |
| A4 = | $0.3996533 \times 10^{-03}$ |
| A5 = | $-.3144822 \times 10^{-08}$ |
| A6 = | $-.2969186 \times 10^{-14}$ |
| A7 = | $0.0000000 \times 10^{+00}$ |
| A8 = | $0.6663320 \times 10^{-09}$ |
| A9 = | $0.2935719 \times 10^{-14}$ |
| A10 = | $-.3869349 \times 10^{-18}$ |
| A11 = | $0.0000000 \times 10^{+00}$ |
| A12 = | $0.1755161 \times 10^{-13}$ |
| A13 = | $0.9320407 \times 10^{-19}$ |
| A14 = | $0.7687528 \times 10^{-25}$ |
| A15 = | $0.2308889 \times 10^{-28}$ |

An electron gun assembly 15 is mounted in a neck portion 12 of the tube opposite the faceplate. Gun assembly 15 produces three horizontal in-line beams R, G and B. A deflection yoke assembly designated generally as 16 is mounted around the neck and flared portion of the tube by a suitable yoke mount or plastic liner 19. Yoke 16 also includes a flared ferrite core 17, a vertical deflection coil 18V and a horizontal deflection coil 18H. Deflection yoke 16 is of the self-convergence type.

Figure 2:
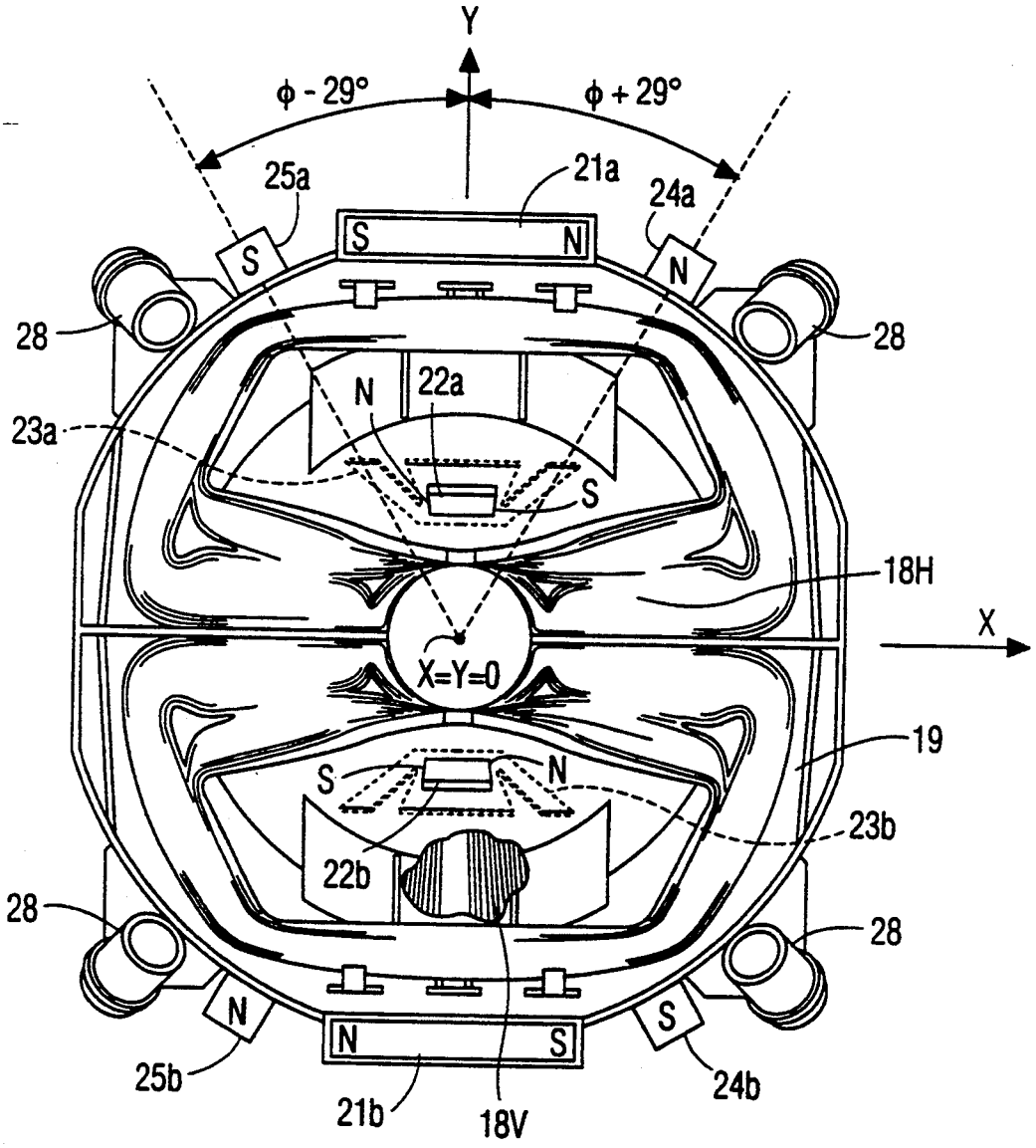
FIG. 2 illustrates a front view of the deflection yoke of FIG. 1 as seen from the display screen of the cathode ray tube.

FIG. 2 illustrates in greater detail deflection yoke 16, embodying an aspect of the invention. Similar symbols and numerals in FIGS. 1 and 2 indicate similar items or functions. In FIG. 2 the yoke assembly is viewed from the electron-beam exit side. Plastic yoke mount 19 of FIG. 2 serves to hold pair of saddle-type horizontal deflection coils 18H in proper orientation relative to flared ferrite core 17 around which vertical deflection winding 18V is wound. Thus, deflection yoke 16 is a saddle-toroid (ST) type. In the side view illustrated in FIG. 3, a beam-exit end is on the right. Similar symbols and numerals in FIGS. 1, 2 and 3 indicate similar items or functions.

A longitudinal or Z-axis of yoke 16 or CRT 10 of FIG. 1 is defined in a conventional manner. In each plane of yoke 16 defined by a corresponding coordinate Z that is perpendicular to the Z-axis, a corresponding Y-axis is defined in parallel to a vertical or minor axis of screen 11. Similarly, a corresponding X-axis is defined in parallel to a horizontal or major axis of screen 11. The coordinate X=Y=0 in each plane of yoke 16 is located on the Z-axis.

In the vicinity of a beam entrance end of yoke 16 of, for example, FIG. 1, a vertical deflection field produced by coil 18V is preferably pincushioned-shaped for correcting vertical coma error. To reduce over-convergence at the 6 and 12 o'clock hour points, the vertical deflection field produced by vertical deflection coil 18V is made barrel-shaped at an intermediate portion of the yoke, between the beam entrance and exit ends of yoke 16 of FIG. 1.

It may be desirable to enhance the degree of barrel-shaped field nonuniformity over what can be obtained by arrangement of the winding distribution of the vertical deflection coil. Accordingly, a pair of field formers or E-shaped shunts **23*a* and 23*b* made of soft or permeable material are mounted near the top and bottom of the yoke in the intermediate portion of the yoke. Field formers 23*a* and 23*b*, embodying an inventive feature, increase the barrel-shaped field nonuniformity and are mounted on the side of plastic yoke mount or insulator 19 that faces vertical deflection winding 18V between vertical deflection winding 18V and the neck of CRT 10**.

FIG. **4*a*, illustrates an example of a convergence pattern of horizontal blue and red lines displayed on screen 11 of FIG. 1. Similar symbols and numerals in FIGS. 1–3, and 4*a* indicate similar items or functions. The convergence pattern example of FIG. 4*a* may result when, instead of shunts 23*a* and 23*b*, conventional rectangular shunts, not shown, are installed. For example, a distance d between a red line RED1 and a blue line BLUE1 at the corner of screen 11**, conventionally referred to as 2:00 o'clock hour point, is equal to −0.49 millimeter. Distance d is taken with respect to the red line. Thus, a negative value d indicates that the red line is above the blue line. Similarly, at the 2:30 o'clock hour point, the distance d is equal to +0.82 millimeter, at 1:00 o'clock hour point, the distance d is equal to −0.56 millimeter and at point A distance d is equal to +0.38 millimeter.

Vertical misconvergence at the 2:00 o'clock hour point and at the 1:00 o'clock hour point is referred to as external or outer horizontal trap error. Whereas, vertical misconvergence at the 2:30 o'clock point and at the A point is referred to as internal or inner horizontal trap error.

Varying the winding distribution of, for example, coil 18V affects both the convergence error d at, for example, the 2:00 o'clock hour point and at the 2:30 o'clock hour point in the same sense. For example, it may make both values more negative; alternatively, it may make both values more positive. A similar situation occurs with respect to coil 18H. It may be desirable to reduce a difference between the external and internal horizontal trap errors. When such difference becomes small, selecting an appropriate winding distribution can result in overall reduction of horizontal trap errors. Advantageously, E-shaped shunts **23*a* and 23*b* vary the vertical deflection field nonuniformity in different degrees when lines RED1 and BLUE1 of FIG. 4*a* are formed on screen 11 and when lines RED2 and BLUE 2** are formed. In this way, the difference between external and internal horizontal trap errors is reduced.

FIG. 5*a* illustrates in detail and with the actual proportion shunt 23*a* or 23*b*, embodying an aspect of the invention. Similar symbols and numerals in FIGS. 1-3, 4*a*, 4*b* and 5*a* indicate similar items or functions. E-shunt 23*a* or 23*b* of FIG. 5*a* is slightly curved to follow the curvature of liner 19 of FIG. 3. The dimensions shown in FIG. 5*a* are applicable to the shunt in its flat condition prior to forming the curvature by bending the shunt. E-shunt 23*a* or 23*b* of FIG. 5*a* includes a connecting member or base 30 that is disposed closer to the beam entrance than to the beam exit side of yoke 16 of FIG. 1. A longitudinal axis $AX_{30}$ of base 30 of FIG. 5*a* is generally perpendicular to the Z-axis. A central leg or branch 31 has a longitudinal axis $AX_{31}$ that is generally parallel to the Z-axis. A front end 31*c* of central branch 31 is placed closer to the beam exit end than the rest of the shunt. A pair of arm-shaped, outer legs or branches 32*a* and 32*b*, are disposed on opposite sides of branch 31 and symmetrically with respect to axis $AX_{31}$. Thus, branches 31, 32*a* and 32*b* are joined together at base 30 and extend from base 30 separately. Back ends 32*ab* and 32*bb* of outer branches 32*a* and 32*b*, respectively, and back end 31*bb* of central branch 31 are remote from the beam exit end and are joined to one another via base 30. Thus, each magnetic path with high permeability exists between each one of branches 32*a*, 32*b* and 31 and each of the other ones of branches 32*a*, 32*b* and 31 and passes through base 30.

Back end 32*ab* of branch 32*a*, for example, is located closer to the beam entrance end than a front end 32*af*. The longitudinal axis $AX_{32a}$ of branch 32*a* forms an angle $\alpha$ with axis $AX_{31}$. Advantageously, the difference in angular position, not shown, with respect to the corresponding Y-axis in which back end 32*ab* is located in its X–Y plane and the angular position, not shown, with respect to the Y-axis in which front end 32*af* is located in the corresponding X–Y plane results in different degrees of deflection field nonuniformity modification of the barrel-shaped vertical deflection field at the different planes. Front end 32*af* of branch 32*a* that is closer to the beam exit end affects more outer horizontal trap error than back end 32*ab*. Conversely, back ends 32*ab* and 32*bb* of branches 32*a* and 32*b*, respectively, that are close to base 30, affect more inner horizontal trap error. By suitable selection of the dimensions associated with branches 32*a*, 32*b* and 31 and of base 30, the difference between outer and inner horizontal trap error can, advantageously, be reduced.

With shunts 23*a* or 23*b* of FIG. 5*a*, the vertical misconvergence error is equal at the 2:00 o'clock hour point to −0.47 millimeter, it is equal at the 1:00 o'clock hour point to −0.48 millimeter, it is equal at the 2:30 o'clock hour point to +0.34 millimeter and it is equal at the A point to +0.2 millimeter. The results indicate that the difference between external and internal horizontal trap errors is, advantageously, smaller than that obtained with the aforementioned prior art rectangular shunt.

FIG. 4*b* illustrates an example of uncorrected external or outer East-West pincushion distortion error and an example of uncorrected internal or inner East-West pincushion distortion error. Similar symbols and numerals in FIGS. 1-3, 4*a*, 4*b* and 5*a* indicate similar items or functions. Customarily, the extent of external East-West pincushion distortion error is determined by the expression:

$$E_r = 2x(d4+d5)+(d6+d7)$$

and that of the internal East-West pincushion distortion error is determined by the expression:

$$I_r = 2x(d8+d9)+(d6+d7)$$

The values d4 to d9 represent corresponding lengths in FIG. 4*b*.

It may be desirable to have the ratio, $$\frac{I_r}{E_r},$$

greater than, for example, 0.35 so that a conventional East-West pincushion distortion correction circuitry can be utilized to correct both errors to acceptable extents.

In accordance with an inventive feature, central branch 31 of FIG. 5*a* increases the ratio $$\frac{I_r}{E_r}$$

between the magnitudes of internal and external East-West raster distortion errors relative to such ratio obtained if branch 31 were removed For example, when central branch 31 is removed, the ratio, $$\frac{I_r}{E_r},$$

is equal to 0.34; whereas, with shunts 23*a* and 23*b* of FIG. 5 that include central portion 31 the ratio, $$\frac{I_r}{E_r},$$

is equal to 0.368. In this way, conventional East-West raster distortion correction circuits, not shown, may be utilized.

FIG. 5*b* illustrates in detail a shunt 23*a*′ embodying an inventive feature. Shunt 23*a*′ of FIG. 5*b* can be used instead of shunt 23*a* of FIG. 5*a*. Shunt 23*a*′ of FIG. 5*b* may provide a greater degree of barrel shaping to the vertical deflection field than shunt 23*a* of FIG. 5*a*. FIG. 5*c* illustrates a cross-section at the back portion of shunt 23*a*′ of FIG. 5*b* in an X–Y plane 110. As shown in FIG. 5*c*, the shunt occupies an angle in the range of 0°–18° in each quadrant. FIG. 5*d* illustrates a front view of the profile of shunt 23*a*′ in the X–Y plane as viewed from the screen. As shown in FIG. 5*d*, shunt 23*a*′ occupies angles between 0°–18° and between 38° and 47° in each quadrant. Similar symbols and numerals in FIGS. 5*a*–5*d* indicate similar items or functions. The angular difference between the front and back portions of the shunt provides the aforementioned required inner/outer horizontal trap error difference and inner/outer East-West pincushion distortion ratio.

FIGS. 6*a*, 6*b*, 6*c*, 6*d*, 6*e* and 6*f* illustrate field distribution functions $V_0(Z)$, $H_0(Z)$, $V_2(Z)$, $H_2(Z)$, $V_4(Z)$ and $H_4(Z)$, respectively, of the deflection fields in yoke 16 of FIG. 1. Similar symbols in FIGS. 1, 2, 3, 4*a*, 4*b*, 5*a*–5*d* and 6*a*–6*f* indicate similar items or functions. The strength or intensity of the magnetic field produced by the deflection coil 18H, for example, of FIGS. 2 and 3 can be measured with a suitable probe. Such measurement can be performed for a given coordinate Z=Z1 of FIG. 3, for a coordinate Y=0 of FIG. 2 and for a given coordinate X=X1. For the purpose of measurement, coordinate X1 varies in the direction of the X-axis, the horizontal deflection direction. The plane in which coordinate X=X1 varies separates the bottom edges of top saddle coil 18H of FIG. 3 from those of bottom saddle coil 18H.

The results of measuring the strength of the magnetic field as a function of coordinate X, for a constant coordinate Z=Z1 and for coordinate Y=0, can be used for computing, in a well known manner, field distribution functions or coefficients $H_0(Z1)$, $H_2(Z1)$, $H_4(Z1)$ and other higher coefficients of a power series $H(X)=H_0(Z1)+H_2(Z1)X^2+H_4(Z1)X^4$. The term H(X) represents the strength of the magnetic field as a function of the X coordinate, at the coordinates Z=Z1, Y=0. A graph can then be plotted depicting the variation of each of the coefficients $H_0(Z)$, $H_2(Z)$, $H_4(Z)$, and other higher order coefficients, as a function of the coordinate Z. In an analogous manner, coefficients $V_0(Z)$, $V_2(Z)$, $V_4(Z)$ and other higher order coefficients can be evaluated as a function of the coordinate Z with respect to vertical deflection coil 18V. To obtain the functions shown in FIGS. 6a–6f, each of the coordinates X and Y are measured in millimeters.

Figure 6C:
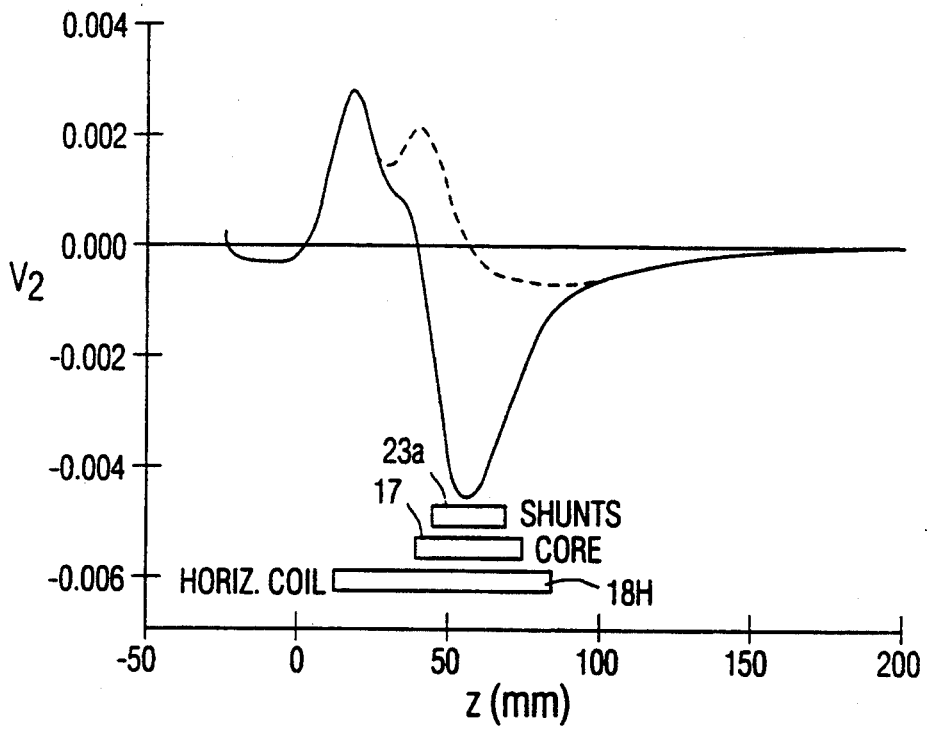
Figure 6D:
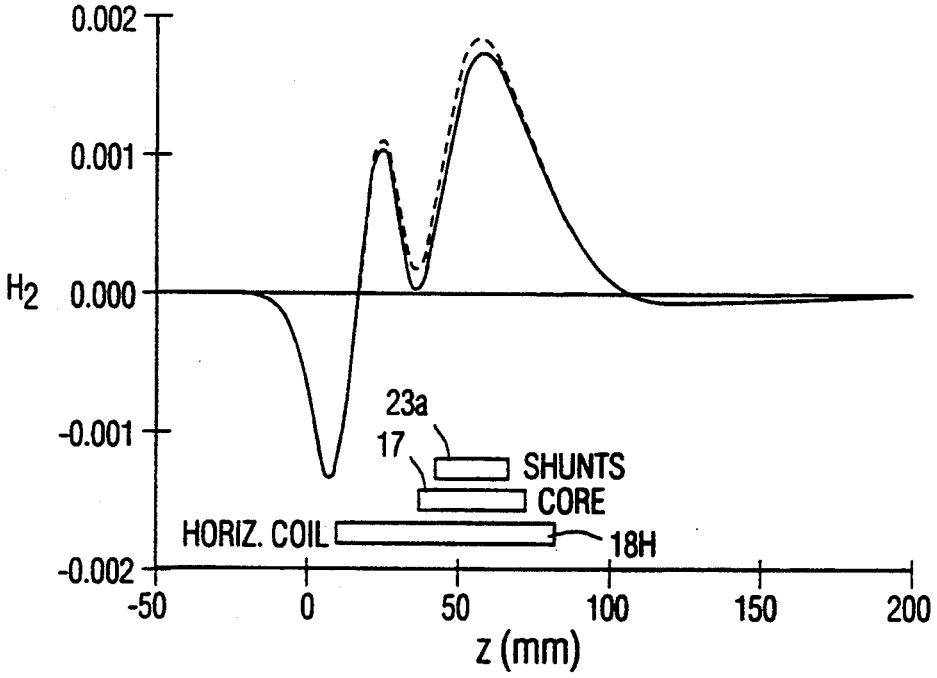
Figure 6E:
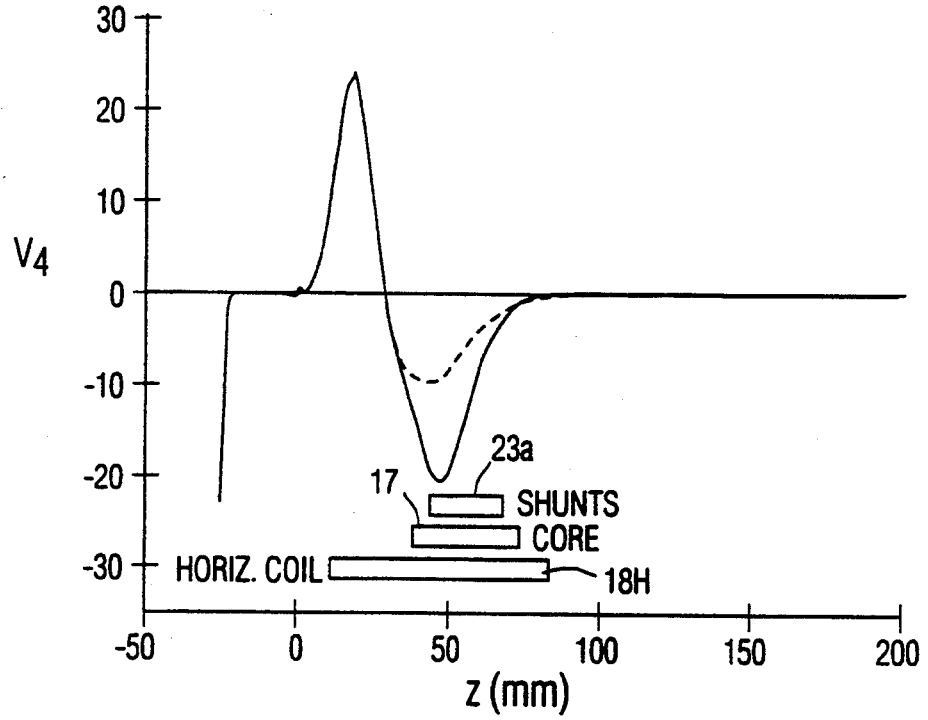
Figure 6F:
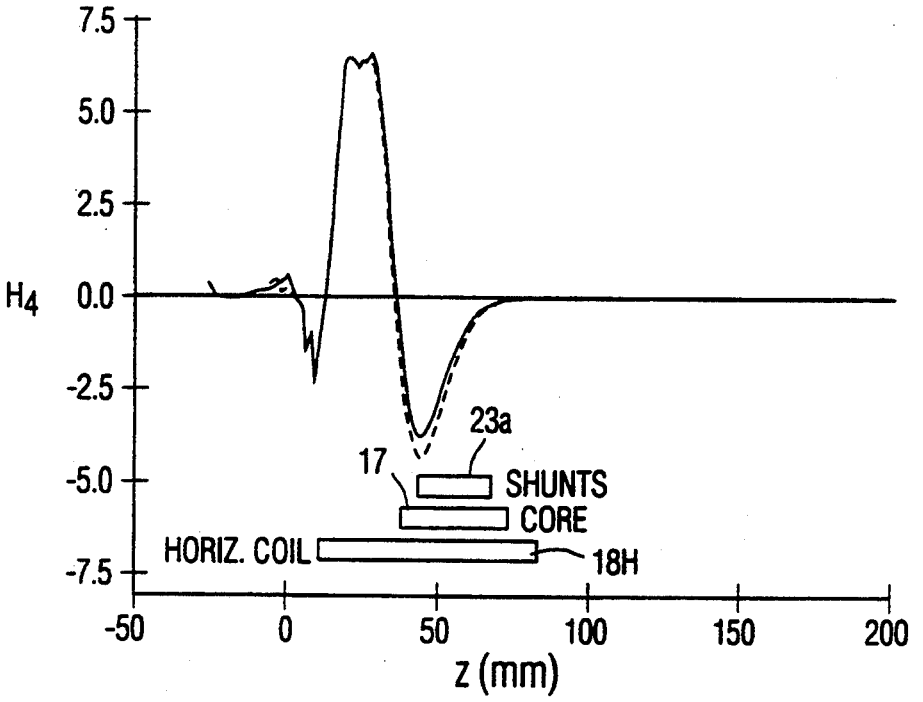

In FIGS. 6a–6f, field distribution function drawn in solid lines are obtained when E-shunts 23a and 23b of FIG. 5a are installed in yoke 16 of FIG. 2. Whereas, field distribution functions drawn in broken lines are obtained when E-shunts 23a and 23b, for illustration purposes only, are removed from yoke 16. The positions of horizontal coil 18H, shunts 23a or 23b and core 17 relative to the Z-axis are also shown in FIGS. 6a–6f. As shown in FIG. 6e, field distribution function $V_4(Z)$ has a peak value at a coordinate Z that is closer to the beam entrance end of shunts 23a or 23b than to its beam exit end. FIG. 6c shows the effect of shunt 23a or 23b on function $V_2(Z)$. As a result of shunt 23a or 23b, the peak of function $V_2(Z)$ attains a larger negative value. Such value corresponds to a barrel-shaped vertical deflection field.

Figure 3:
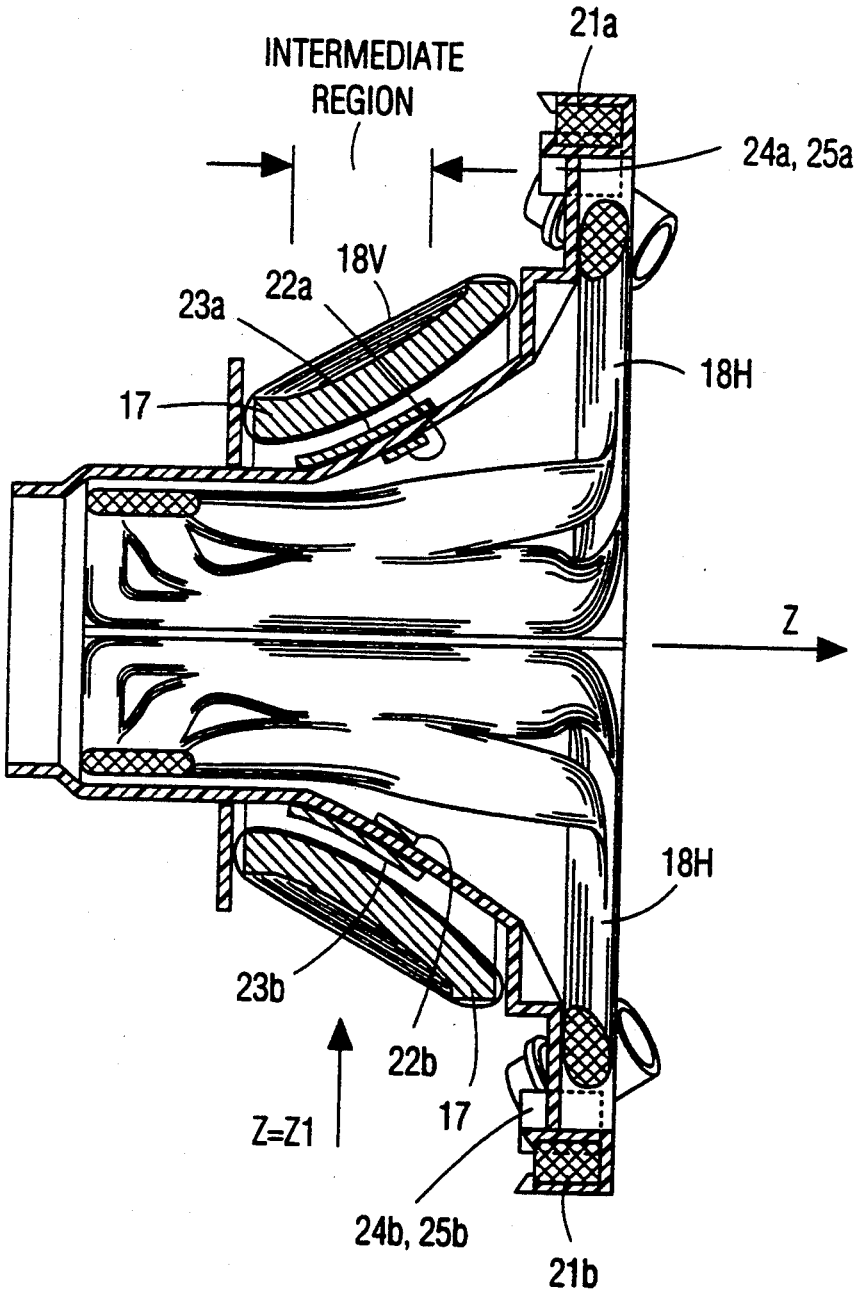
FIG. 3 illustrates a side view of the yoke of FIG. 1 in more detail.

To correct N–S raster distortion, a pair of magnets 21a and 21b of FIGS. 2 and 3 are mounted near the top and bottom, respectively, of the yoke at the front or beam-exit portion of the yoke. Magnets 21a and 21b are affixed in recesses in mount 19 and are poled as indicated. Magnets 21a and 21b of FIG. 2 that are disposed near the beam exit end of the yoke are used to correct external North-South (top-bottom) pincushion distortion.

Magnets 21a and 21b may degrade the barreling of the vertical deflection field necessary to provide proper convergence. To restore in part the barreling of the vertical deflection field, a pair of magnets 22a and 22b is disposed adjacent the flared inner surface of the yoke at the top and bottom closer towards the beam-entrance end of the yoke. Magnets 22a and 22b are mounted to conform to the contour of coil 18H and disposed between coil 18H and the neck of CRT 10. Magnets 22a and 22b as well as E-shunts 23a and 23b compensate for the vertical convergence error that might be otherwise introduced by magnets 21a and 21b, respectively. The convergence error compensation is obtained because of the resulting increase of the barreling of the vertical deflection field in a region of the deflection field that is further away along the Z-axis from the screen of CRT 10 than magnets 21a and 21b.

To correct internal N–S geometry distortion, a pair of permanent corner magnets 24a and 25a of FIG. 2 are mounted on liner 19 at opposite sides of top magnet 21a. Magnet 24a is disposed approximately at angle $\phi=+29°$ and magnet 25a is disposed approximately at angle $\phi=-29°$ and symmetrically with respect to the corresponding Y-axis. Thus, each of magnets 24a and 25a is disposed closer to the Y-axis than to the X-axis because angle $\phi$ is smaller than 45°.

A pair of corner magnets 24b and 25b of FIG. 2 are disposed symmetrically to magnets 24a and 25a, respectively, with respect to the X-axis. Corner magnets 24b and 25b are disposed at opposite sides of magnet 21b. Magnets 24a, 21a and 25a affect beam spot landing position mainly when the beam spot is above the vertical center of the screen of the CRT. In a similar manner, magnets 24b, 21b and 25b affect it mainly when the beam spot is below the vertical center.

What is claimed is:

1. A deflection apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

a vertical deflection coil and a horizontal deflection coil for producing a deflection field in said cathode ray tube;

a core made of magnetically permeable material magnetically coupled to said vertical and horizontal deflection coils; and a pair of field formers disposed adjacent to at least one of said deflection coils between a beam entrance end and a beam exit end thereof at the top end and a bottom end, respectively, of a Y-axis and symmetrically with respect to an X-axis of said yoke, each of said field formers including a center leg and two outer legs spaced apart in a transverse direction and a member connecting together the plurality of legs.

2. A deflection apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

a vertical deflection coil and a horizontal deflection coil for producing a deflection field in said cathode ray tube;

a core made of magnetically permeable material magnetically coupled to said vertical and horizontal deflection coils; and a first field former disposed adjacent to one of said deflection coils and between a beam entrance end and a beam exit end thereof for modifying said deflection field, including a center leg and two outer legs spaced apart in a transverse direction and a member connecting together the plurality of legs.

3. An apparatus according to claim 2 wherein said field former is disposed at one of a top end and a bottom end of a Y axis of said yoke.

4. An apparatus according to claim 3 further comprising, a second field former disposed symmetrically to said first field former at the other one of said top and bottom ends of said Y axis.

5. An apparatus according to claim 2 wherein an angle between longitudinal axes of said center leg and one of said outer legs is substantially smaller than 90°.

6. An apparatus according to claim 3 wherein corresponding portions of at least one of said outer legs are disposed at different X–Y planes of said yoke and, in each X–Y plane, the corresponding portions are disposed at different angular positions with respect to a Y-axis in such plane for reducing a difference between an inner horizontal trap error and an outer horizontal trap error.

7. An apparatus according to claim 6 wherein said central leg increases a ratio between a magnitude of an inner East-West pincushion distortion and a magnitude of an outer East-West pincushion distortion.

8. An apparatus according to claim 2 wherein said field former is disposed in said yoke in a manner to significantly increase a field distribution function $V_2(Z)$ of said yoke.

9. An apparatus according to claim 2 wherein said field former is disposed in said yoke in a manner to significantly increase a degree of a barrel-shaped field nonuniformity of said vertical deflection field to provide for convergence of said beams.

10. An apparatus according to claim 2 wherein said field former is disposed in said yoke in a manner to significantly increase a field distribution function $V_4(Z)$ of said yoke.

11. An apparatus according to claim 10 wherein a peak value of said function $V_4(Z)$ occurs in a vicinity of an end portion of said field former that is remote from said screen.

12. An apparatus according to claim 2 wherein said connecting member is disposed perpendicularly to a direction of a longitudinal axis of said central leg and to a Z-axis of said yoke.

13. An apparatus according to claim 2 wherein each of said center and outer legs runs generally in the Z-axis direction.

* * * * *